United States Patent [19]

Probstein et al.

[11] 4,261,419

[45] Apr. 14, 1981

[54] UNDERGROUND RECOVERY OF NATURAL GAS FROM GEOPRESSURED BRINES

[75] Inventors: Ronald F. Probstein, Brookline; Richard E. Hicks, Waban, both of Mass.

[73] Assignee: Water Purification Associates, Cambridge, Mass.

[21] Appl. No.: 48,650

[22] Filed: Jun. 14, 1979

[51] Int. Cl.[3] ..... E21B 43/00; E21B 43/40

[52] U.S. Cl. ..... 166/52; 166/53; 166/265; 166/314; 405/53

[58] Field of Search ..... 405/53, 59; 166/265, 166/52, 314, 305 D, 53; 299/8

[56] References Cited

U.S. PATENT DOCUMENTS

| | | | |
|---|---|---|---|
| 3,363,692 | 1/1968 | Bishop | 166/305 D |
| 4,040,487 | 8/1977 | Cook et al. | 166/314 |
| 4,090,564 | 5/1978 | Cook et al. | 166/314 |
| 4,091,623 | 5/1978 | Edmondson et al. | 60/641 |
| 4,116,276 | 9/1978 | Cook et al. | 166/314 |
| 4,119,349 | 10/1978 | Albescu et al. | 166/265 X |

FOREIGN PATENT DOCUMENTS

| | | | |
|---|---|---|---|
| 1468258 | 12/1966 | France | 166/305 D |

OTHER PUBLICATIONS

Hodgson, "Natural Gas: The Search Goes On", *National Geographic,* vol. 154, No. 5, Nov. 1978, pp. 632–641, 648–651.

Wilson, "A Geothermal Energy Plant", Chemical Engineering Progress, Nov. 1977, pp. 95–98.

*Primary Examiner*—Stephen J. Novosad

*Attorney, Agent, or Firm*—Robert F. O'Connell

[57] ABSTRACT

A technique for recovering natural gas from geopressured brines contained in a first aquifer in which the brine is conveyed from the high pressure geopressured aquifer to an underground chamber at lower pressure at a location remote from the geopressured aquifer, the lower pressure within the chamber causing the gas to be released from the brine after entry into the chamber. The released gas is conveyed from the chamber to a suitable gas outlet for use while the brine within the chamber by virtue of its pressure is conveyed to a second upper level discharge aquifer at a location remote from the chamber.

8 Claims, 1 Drawing Figure

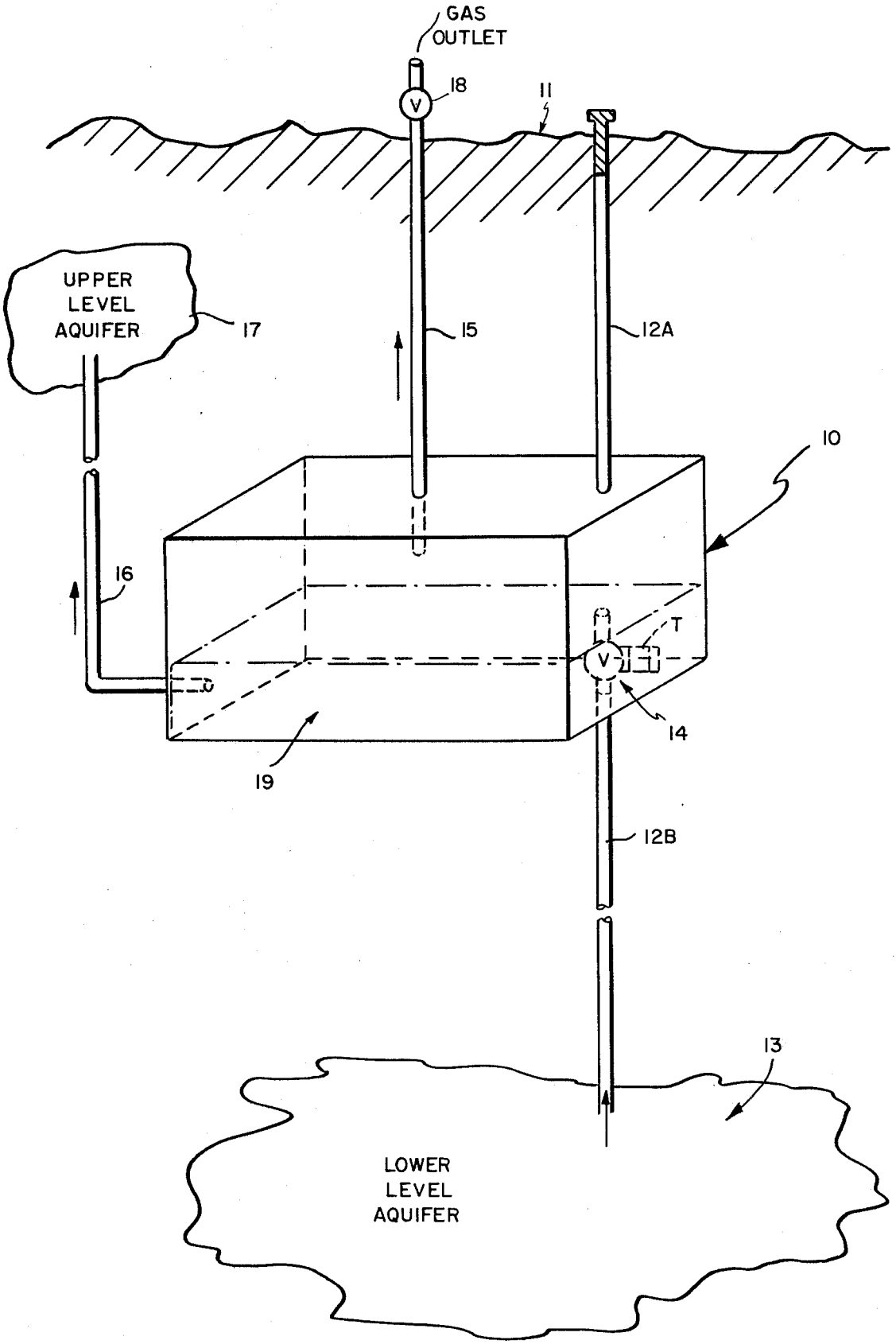
GAS
OUTLET
18
11
UPPER
LEVEL
AQUIFER
17
15
12A
10
16
T
14
19
12B
13
LOWER
LEVEL
AQUIFER

UNDERGROUND RECOVERY OF NATURAL GAS FROM GEOPRESSURED BRINES

INTRODUCTION

This invention relates to techniques for recovering natural gas and, more particularly, to techniques for recovering natural gas underground from geopressured brines.

BACKGROUND OF THE INVENTION

In many regions of the world, particularly, for example, in the Texas and Louisiana Gulf Coast regions as well as other regions of the western United States, extensive reservoirs of deep, geopressured saline waters, or brines, that are saturated with natural gas, i.e., methane, are present. Such brines exist in large formations of geopressured tertiary sandstones which contain huge aquifers at depths typically from a few thousand feet to over 25,000 feet. The particular aquifers in the above geographical regions are characterized by relatively high pressures which, for example, can be as much as twice the normally expected pressures in other aquifers at a comparable depth and may be characterized by relatively high temperatures of the order of 150° C. or greater. The geological conditions of such aquifers tend to favor the formation of methane gas from the organic matters present.

The methane gas content which is dissolved in such brines has been estimated to be approximately 1.0 cu. ft./gal. of water, recent tests showing that in exemplary regions 40 to 50 cubic feet of methane is dissolved in each barrel of water taken from an exploratory well at a depth of 16,500 feet.

United States geological surveys have reported that the geopressured salt water in onshore reservoirs of this nature may contain as much as 24,000 trillion cubic feet of methane and it has been further estimated that even more gas may be found offshore. In fact, one estimate has indicated that the geopressured gas reserves of the entire Gulf of Mexico region may be more than 100,000 trillion cubic feet, an amount which could go far toward solving the problem of energy shortage if such reserves can be appropriately developed.

DISCUSSION OF THE PRIOR ART

Present proposals for recovering the natural gas which is dissolved in geopressured brines introduce considerable difficulties. Such proposals involve bringing the highly saline water to a position above the earth's surface and utilizing the pressure of the saline water at such point to perform work by supplying the brine to hydraulic turbines which permit the pressure energy to generate electricity, for example. The pressure on the saline water at the output of such turbines being reduced, the methane gas dissolved therein is released therefrom and then recovered. The pressure may be further reduced for more complete recovery of the dissolved gas.

Bringing the water to a point above the earth's surface for such processing requires equipment at the surface which must be capable of handling extremely large volumes of saline water, which water, following the turbine operation and the gas recovery process, must then somehow be disposed of. For example, even a relatively small generating plant, e.g., one which generates approximately 25 megawatts of electrical energy by the use of such pressure energy, sometimes coupled with the use of the thermal energy present in the brine, might require in an exemplary system a water throughput of about 17 million gallons per day. The handling and the disposal of such quantities of water using presently known techniques becomes an extremely difficult problem.

While it has been suggested that such highly saline water be treated to bring it to a quality suitable for surface discharge, such treatment turns out to be economically impractical. Even at a conservative brine concentration of about 10,000 milligrams per liter, upwards of 700 tons per day of salt would have to be removed from the water, an extremely costly process using presently known techniques. Moreover, the recovery of the salt as soda ash or chlorine seems an unfeasible approach since there is no real market for such large quantities at present. Accordingly, rather than purify the water for surface use or disposal, such systems propose to reinject the brine into the earth. Such reinjection processes give rise to both environmental and technical problems.

Moreover, the use of such highly concentrated brine solutions gives rise to corrosion problems for the turbines to which it is supplied as well as to other equipment which is used in the process. Such corrosion difficulties only further aggravate the handling and processing of the brine and further increase the expense of the presently proposed processes.

It is desirable, therefore, to devise a technique for recovering gas from such geopressured brines without giving rise to the above problems associated with systems presently proposed.

BRIEF SUMMARY OF THE INVENTION

In one preferred embodiment of the technique of the invention, gas can be recovered from the geopressured brines without bringing large quantities of saline water to the surface, which after use and methane removal must then be disposed of. For example, in a preferred embodiment of the invention an underground chamber is formed below the earth's surface at a selected depth within the hydrostatic pressure zone. A suitable well drilled from the earth's surface through the underground chamber extends to a lower aquifer below the underground chamber in which the geopressured brine resides. The brine, which is saturated with natural gas, is conveyed from the lower aquifer to the underground chamber. The brine enters the chamber at a relatively high pressure and the lower pressure maintained within the chamber causes the natural gas to flash, or be released, from the brine, the latter forming a reservoir within the chamber. The portion of the well from the earth's surface to the chamber may be used to convey the released gas to the surface where it can be collected for use. Alternatively, this well may be blocked and a separate gas well drilled from the earth's surface to the underground chamber for the purpose of conveying the released gas to the surface. A conduit (or a series of conduits), which leads from the reservoir of brine within the chamber to a second upper, or discharge, aquifer above the lower aquifer is used to convey the lower pressure brine from which most of the methane has been removed, from the chamber into the discharge aquifer, which is at a pressure still lower than that in the chamber.

Thus, the natural gas is recovered from the brine without the need for an extensive handling and processing system and without the need to dispose of the very large quantities of highly corrosive brines as in presently proposed systems. Moreover, the invention provides environmental, as well as process, advantages which are attractive and avoid the environmental problems which face the presently proposed systems.

DESCRIPTION OF THE INVENTION

The invention can be described in more detail with the help of the accompanying drawing wherein the sole FIGURE depicts in diagrammatic form a particular embodiment of the technique of the invention.

As shown in the FIGURE, an underground chamber 10 is mined out at a selected depth below the surface 11 of the earth. For simplicity, the underground chamber is shown as generally rectangular in configuration, although its exact shape need not be limited thereto. In the embodiment shown, the location of the underground chamber 10 lies within what is generally designated as the hydrostatic pressure zone below the earth's surface, which pressure zone will extend from the surface of the earth to the top of what is designated as the geopressure zone, which may begin at depths of from 5,000 to 10,000 feet, for example. A liquid well 12 is drilled from the earth's surface through the underground chamber 10 to the geopressure zone comprising an aquifer 13 containing brines saturated with natural gas, e.g., methane gas. The upper portion 12A is suitably blocked following completion of the well while the lower portion 12B extends from the underground chamber 10 to lower aquifer 13.

A suitable remote controlled valve and throttle assembly 14, which can be of a type well known to those in the engineering art, for example, is positioned at the upper end of well 12B above its entry point into the chamber 10. A gas well 15 is drilled from the earth's surface 11 to the underground chamber 10 for the purpose of collecting and removing the gas from the chamber. In some systems the well 12A may be utilized for the removal of the gas, thus dispensing with the need to provide a separate gas well 15. A conduit 16 leading from chamber 10 to a discharge aquifer 17 is utilized to remove the lower pressure brine from which most of the methane has been released from region 10 as discussed below.

In accordance with the operation of the system shown in the FIGURE, the brine under high pressure which is present in aquifer 13 is automatically conveyed from such aquifer to chamber 10 via well 12B, the flow thereof being suitably controlled by a remote control valve and throttling assembly 14 at the entrance to the chamber. The pressure within the underground chamber is controlled at a suitable value by means of a pressure control valve 18 at the top of the gas well and by the valve and throttling system 14 at the top of well 12B. The pressure in chamber 10 will generally be controlled at a pressure which is sufficiently low that a maximum amount of the methane gas which is dissolved in the brine is released therefrom within the chamber. The brine entering the chamber forms a reservoir 19 in the lower region thereof.

Because of the pressure difference between the pressure within chamber 10 and the pressure at the surface, such released gas is automatically conveyed through gas well 15 and pressure control valve 18 to the surface where it can be appropriately collected for use in accordance with standard techniques well known to the art.

While the pressure in the chamber will be so controlled as to release most of the gas in the brine, such pressure is still generally controlled so as to be sufficiently high to drive the brine in reservoir 19 to the upper level discharge aquifer 17 due to the pressure difference between the pressure within the chamber and that at the discharge aquifer. The level of the brine in reservoir 19 may be controlled by appropriate adjustment of the pressure in chamber 10, by the rate of gas withdrawal, and by the valve and throttling system 14. A level indicator/transducer (not shown) coupled to an automatic control system familiar to those skilled in the art may be provided.

Once the system is set into operation, the operation thereof proceeds on a continuous basis, the brine being continuously released therefrom and conveyed from chamber 10 to the surface, and the brine being continuously conveyed from chamber 10 to upper level aquifer 17.

In the preferred embodiment shown in the FIGURE the chamber 10 below the earth's surface effectively acts as a natural container. No pumps are needed since the pressure differences discussed above are such that brine and gas are appropriately conveyed as desired without them and the need for manufactured processing units is effectively minimized. The remote control valve and throttling assembly 14 can be fabricated of appropriate material available to those in the art which will not be subject to corrosion.

The preferred technique of the invention specifically described above avoids the necessity for the handling of brine in processing equipment which is subject to corrosion and also avoids the problem of disposing from the surface extremely large quantities of such highly corrosive brines which arises with the presently proposed systems. In the particular embodiment shown, for example, the brine is suitably disposed of directly from underground chamber 10 into a natural aquifer 17 via conduit 16. The overall gas release and disposal process proceeds substantially automatically once the system is placed into operation.

As one illustrative example of a system which could be utilized in accordance with the specific embodiment shown in the drawing, a geopressured aquifer, or brine zone, 13 may be located, for example, at approximately 15,000 feet below the surface 11 of the earth. It has been estimated that the methane gas content thereof will be approximately 1 cubic foot of gas, at standard temperature and pressure, per gallon of water. The salinity of such brine may be up to 160,000 parts per million (ppm). In an exemplary system the underground chamber 10 may be located at approximately 1000 feet below the surface of the earth, at a position reasonably near an upper level discharge aquifer 17 which may be located, for example, approximately 500 feet below the surface of the earth.

In such configuration the hydrostatic pressure at lower aquifer 13 may be approximately 6500 psi while the actual pressure (due to the geopressure effects) may be about 13,000 psi. At the level of chamber 10 the hydrostatic pressure may be about 430 psi while the brine pressure may be about 5600 psi. The pressure within chamber 10 may be controlled by means of pressure control valve 18, and by the valve and throttling system 14, at about 600 psi. The hydrostatic pressure at the upper level aquifer 17 may be about 215 psi.

Thus, the pressure difference between aquifer 13 and the upper end of well 12B at the entrance to chamber 10 is sufficient to force the gas-saturated brine upwardly therethrough (as shown by the arrows) into chamber 10 where such brine becomes depressurized and releases most of the methane gas dissolved therein. The gas, because of the pressure difference between the pressure within the chamber and the pressure at the surface of gas well 15, is conveyed upwardly to the surface as shown. The pressure difference between pressure within chamber 10 and the pressure at upper aquifer 17 is sufficient to convey the brine from the reservoir 19 thereof in chamber 10 to upper aquifer 17 where the brine is appropriately distributed throughout the aquifer.

The fabrication of liquid and gas wells 12 and 15, respectively, and the formation of chamber 10 are all well within the skill of those in the art. For the above illustrative example, the dimensions of the chamber may be such that the length is approximately ten feet, the height approximately eight feet, and the width approximately five feet.

A single source well 12 which is 7" in diameter is estimated to be capable of bringing approximately 40,000 barrels per day, or $1.68\times10^6$ gallons per day, of brine from a geopressure aquifer 13 at about 15,000 feet to the chamber 10 located at approximately 1000 feet. Since the geopressure at aquifer 13 is approximately double the hydrostatic pressure at such depth, and the pressure drop, as the brine flows upwardly in the source well, is about 100 psi for each thousand foot length, the pressure at the entrance to chamber 10, accounting also for the loss in hydrostatic head pressure, provides a brine pressure of about 5600 psi at such entry point.

If the pressure of the chamber is controlled to be at about 600 psi, the methane solubility in the saline water is reduced from 1 cubic feet/gallon to about 0.04 cubic feet per gallon. If 90% of the methane which is released from the solution can be recovered, the gas production rate for such a typical illustrative example will be approximately 0.86 cubic feet of methane gas per gallon of brine, or about $1.44\times10^6$ cubic feet of methane gas per day.

To facilitate separation of the gas bubbles from the brine within the chamber, the depth of the reservoir of brine in the chamber is controlled to remain below about 18 inches for the illustrative example and the residence time of the brine within the chamber is of the order of magnitude of approximately twenty to thirty seconds. The gas leaving the brine enters the gas space above the reservoir for removal via gas well 15, the gas velocity in the pressure reduction chamber 10 being typically less than about 0.01 foot per second to insure adequate disengagement of entrained water. A conventional demister device of a type well known to those in the art, can be located at the lower end of gas well 15 so as to further assist in removal of water droplets from the gas.

While a single source well 12 for supplying brine to a single chamber which ultimately produces gas for conveyance via a single gas well 15 has been depicted in the FIGURE, the invention need not be limited thereto. Thus, one or more source wells 12B may be utilized to feet the same chamber, or a plurality of chambers may be utilized, each one being feet by one or more source wells. Further, one or more outlet conduits 16 may be utilized at each chamber for discharging to one or more aquifer regions 17. Further, one or more gas wells 15 may be utilized to convey the separated gas to the surface from each chamber. Appropriate debris filters may also be fitted upstream of the gas well, as required, as well as the demister device mentioned above. The discharge conduits 16 may also be fitted with suitable flow control or check valves as desired.

In some applications where the chamber pressure is reduced essentially to hydrostatic pressure, pumps may be utilized to inject the de-pressurized, de-gassed brine from reservoir 19 into an upper level aquifer 17 via one or more conduits 16. If desired, an impingement baffle may be located above the source well entrance into the chamber so as to deflect the incoming brine and distribute it within the chamber. Further, appropriate means well known to those in the art for pressure regulation and liquid level control within the chamber may also be utilized.

The location of underground chamber 10 is not limited to the specific illustrative example discussed above and the configuration of the overall system may be appropriately modified both in the locations of the various components thereof and in the dimensions and shapes thereof as desired by the particular application for which the system is to be used. Further, the underground chamber may be one that is naturally formed.

Other modifications of the invention may occur to those in the art within the spirit and scope thereof and the invention is not to be considered as limited to the specific embodiments discussed above, except as defined by the appended claims.

What is claimed is:

1. A system for recovering gas dissolved in a liquid contained in a first aquifer at a first location below the earth's surface, said system comprising at least one underground chamber formed at a second location below the earth's surface and remote from said first location, said at least one underground chamber having at least one liquid entry, at least one gas exit, and at least one liquid exit;

at least one liquid well extending from said at least one underground chamber to said first aquifer for conveying the liquid from said first aquifer to said at least one liquid entry, the pressure of said liquid at said entry being greater than the pressure within said at least one underground chamber so that upon entry of said liquid into said at least one underground chamber the gas dissolved in said liquid is released therefrom and said liquid forms a reservoir in said at least one underground chamber;

at least one gas well extending from said at least one gas exit of said at least one underground chamber to a gas outlet for conveying said released gas from said at least one underground chamber to said gas outlet to make said gas available for use; and at least one conduit extending from said at least one liquid exit of said at least one underground chamber to at least one second aquifer at a third location remote from said at least one underground chamber to convey liquid from said reservoir to said at least one second aquifer.

2. A system in accordance with claim 1 wherein the depth of said first aquifer below the earth's surface is greater than the depth of said at least one second aquifer.

3. A system in accordance with claim 2 wherein said first aquifer is within the geopressure zone below the earth's surface and said at least one underground chamber is within the hydrostatic zone below the earth's surface.

4. A system in accordance with claims 1 or 3 wherein the geopressure of said liquid at said first aquifer is above the hydrostatic pressure and the pressure within said at least one underground chamber is substantially below said geopressure.

5. A system in accordance with claims 1 or 4 wherein the pressure at said second aquifer is below the pressure within said at least one underground chamber.

6. A system in accordance with claims 1 or 5 and further including means for controlling the flow of said liquid into said at least one underground chamber.

7. A system in accordance with claim 6 and further including means for controlling the flow of gas from said at least one underground chamber.

8. A system in accordance with claim 7 and further including means for controlling the level of said liquid in said at least one underground chamber.

* * * * *